US008322701B2

(12) United States Patent
Hattori et al.

(10) Patent No.: US 8,322,701 B2
(45) Date of Patent: Dec. 4, 2012

(54) IMAGE FORMING APPARATUS

(75) Inventors: Hitoshi Hattori, Tokyo (JP); Shuuya Nagasako, Kanagawa (JP); Naohiro Kikkawa, Kanagawa (JP); Takashi Saito, Kanagawa (JP); Naoyuki Ishikawa, Kanagawa (JP); Yuusuke Shibasaki, Kanagawa (JP); Hidetoshi Kojima, Miyagi (JP); Naoki Oikawa, Miyagi (JP); Go Aiba, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 64 days.

(21) Appl. No.: 12/923,351

(22) Filed: Sep. 16, 2010

(65) Prior Publication Data

US 2011/0076081 A1 Mar. 31, 2011

(30) Foreign Application Priority Data

Sep. 30, 2009 (JP) ..... 2009-228103
May 18, 2010 (JP) ..... 2010-114682

(51) Int. Cl.
*B31F 1/08* (2006.01)

(52) U.S. Cl. ..... 270/45; 270/20.1; 270/32; 270/58.07

(58) Field of Classification Search ..... 270/20.1, 270/32, 37, 45, 51, 58.07; 493/396, 397, 493/399

See application file for complete search history.

(56) References Cited

U.S. PATENT DOCUMENTS

| | | | | |
|---|---|---|---|---|
| 7,562,866 | B2 * | 7/2009 | Hayashi | 270/58.07 |
| 7,597,311 | B2 * | 10/2009 | Kawata et al. | 270/37 |
| 7,740,238 | B2 * | 6/2010 | Iijima et al. | 270/37 |
| 7,770,876 | B2 * | 8/2010 | Sasahara | 270/32 |
| 2007/0126165 | A1 * | 6/2007 | Kawata et al. | 270/37 |
| 2008/0211159 | A1 * | 9/2008 | Iijima et al. | 270/37 |
| 2009/0051100 | A1 | 2/2009 | Hattori et al. | |
| 2009/0062096 | A1 * | 3/2009 | Sasahara | 493/396 |
| 2009/0121408 | A1 * | 5/2009 | Awano | 270/37 |
| 2009/0152789 | A1 | 6/2009 | Kikkawa et al. | |
| 2009/0181840 | A1 * | 7/2009 | Awano | 493/399 |
| 2009/0200725 | A1 | 8/2009 | Tamura et al. | |
| 2009/0258774 | A1 | 10/2009 | Suzuki et al. | |
| 2010/0207314 | A1 | 8/2010 | Hattori et al. | |

FOREIGN PATENT DOCUMENTS

| | | |
|---|---|---|
| JP | 60-262771 | 12/1985 |
| JP | 2008-081258 | 4/2008 |

* cited by examiner

*Primary Examiner* — Leslie A Nicholson, III

(74) *Attorney, Agent, or Firm* — Harness, Dickey & Pierce, P.L.C.

(57) ABSTRACT

An image forming apparatus includes an image forming unit that forms an image on a recording medium; a conveying unit that conveys the recording medium on which the image is formed; a crease forming unit that performs a crease forming process on the conveyed recording medium; a determining unit that determines whether or not the recording medium is a predetermined recording medium; and a control unit that prohibits the crease forming process from being performed by the crease forming unit when the determining unit determines that the recording medium is the predetermined recording medium.

7 Claims, 17 Drawing Sheets

IMAGE FORMING APPARATUS

CROSS-REFERENCE TO RELATED APPLICATIONS

The present application claims priority to and incorporates by reference the entire contents of Japanese Patent Application No. 2009-228103 filed in Japan on Sep. 30, 2009 and Japanese Patent Application No. 2010-114682 filed in Japan on May 18, 2010.

BACKGROUND OF THE INVENTION

1. Field of the Invention

The present invention relates to an image forming apparatus that forms a crease in a recording medium and forms an image.

2. Description of the Related Art

When a folding process is performed on paper after an image is formed by an image forming apparatus, as illustrated in FIGS. 1A and 1B, an image formed in a mountain portion $P_a$ or a valley portion $P_b$ of a crease of paper P may be peeled off (that is, an image may crack). The folding process is a process of folding the paper in two. A crease forming device that forms a crease in a portion of paper to be folded before performing the folding process has been proposed (see Japanese Patent Application Laid-open No. 2008-81258). In the crease forming device, a crease blade abuts on the paper to form a crease in an abutting portion. A crease forming process is referred to as a crease process, and the crease forming device is called a creaser.

In the crease forming device disclosed in Japanese Patent Application Laid-open No. 2008-81258, transportation of paper needs to be stopped when forming the crease in the paper. In addition, with regard to the crease forming device disclosed in Japanese Patent Application Laid-open No. 2008-81258, the crease forming process needs to be performed on every sheet of paper that is to be subjected to the folding process, so that there is a problem in that productivity of the crease forming process is low. Furthermore, since the crease blade abuts on every sheet of paper that is to be subjected to the folding process, the crease blade is easily worn out due to the repulsive force from a cradle for a crease blade, whereby the replacement cost of the crease blade increases. Still further, when the crease forming device is broken due to some reasons while the paper is transportable, the crease forming process may not be performed and as a result thereof there may be a time period in which the process can not be performed at all (hereinafter, referred to as "downtime").

SUMMARY OF THE INVENTION

It is an object of the invention to at least partially solve the problems in the conventional technology.

According to an aspect of the present invention, there is provided an image forming apparatus that includes an image forming unit that forms an image on a recording medium; a conveying unit that conveys the recording medium on which the image is formed; a crease forming unit that performs a crease forming process on the conveyed recording medium; a determining unit that determines whether or not the recording medium is a predetermined recording medium; and a control unit that prohibits the crease forming process from being performed by the crease forming unit when the determining unit determines that the recording medium is the predetermined recording medium.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1A:
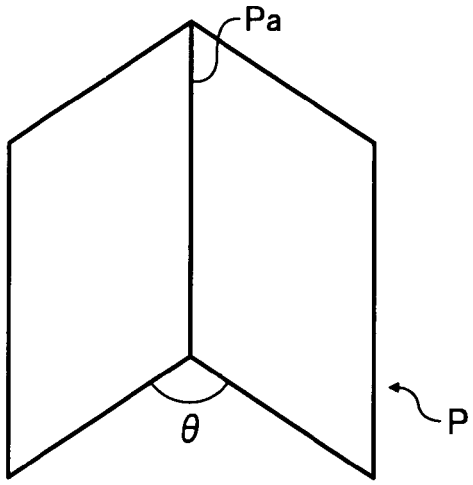
FIGS. 1A and 1B are perspective views illustrating paper that is folded in two.

Exemplary embodiments of the invention will be described with reference to the accompanying drawings. Components having the same functions or procedures for performing the same processing are denoted by the same reference numerals, and duplicated description will not be repeated.

Description of Terms

First, terms used below will be described. An "image forming apparatus" includes, for example, a printer, a facsimile, a copy machine, or a complex machine thereof. A "recording medium" includes, for example, paper, thread, fiber, leather, metal, plastic, glass, wood, ceramics, or film coat. Further, "image forming" represents forming an image such as letters, graphics, or pattern, or simply having liquid droplets land on the recording medium. Further, a "liquid droplet" represents, for example, ink. The term "Ink" is not limited to what is called ink. The liquid droplet is used as a collective term for all liquids for forming an image, including what is called a recording liquid, a fixing processing solution, and a liquid, and also includes, for example, a DNA sample, a resist, and a pattern material.

Unless otherwise set forth hereinafter, the term paper is recording medium.

Crease Forming Process

Figure 2:
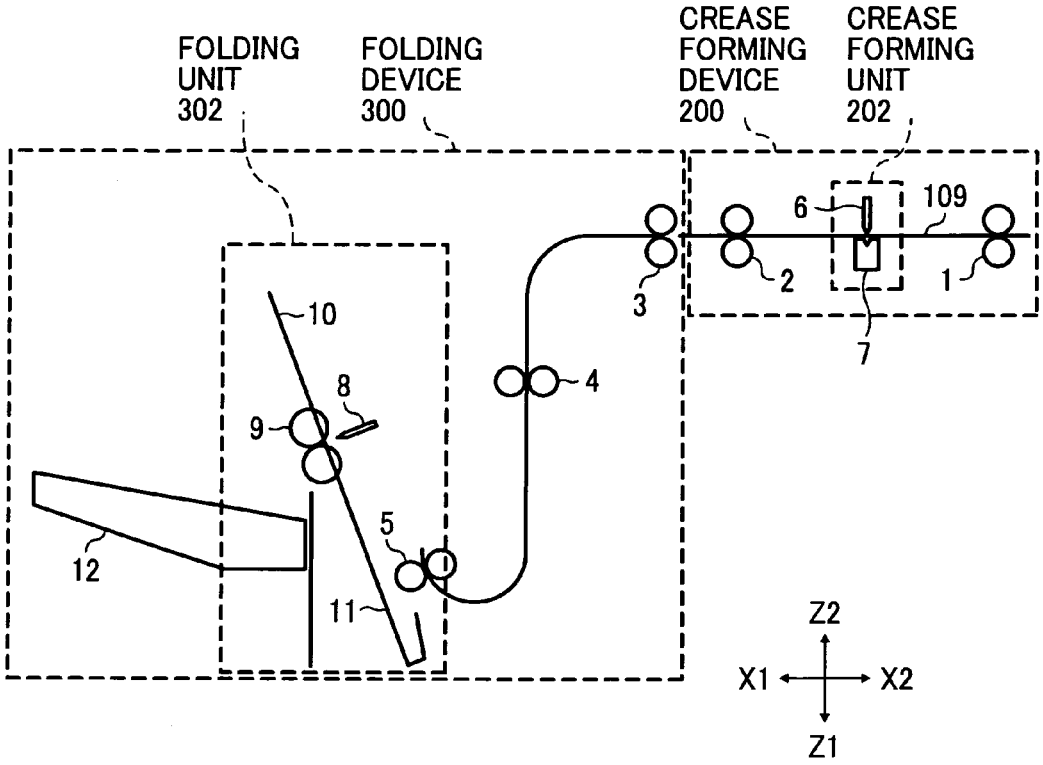
FIG. 2 is a schematic view illustrating a crease forming device and a folding device.

Next, the crease forming process will be described. FIG. 2 illustrates an exemplary simplified functional structure of a crease forming device 200 and a folding device 300 according to an embodiment. As illustrated in FIG. 2, the crease forming device 200 is disposed at an upstream side of the folding device 300. As illustrated in FIG. 2, the crease forming device 200 includes a crease forming unit 202, a conveying unit 109, a pair of conveying rollers 1, and a pair of conveying rollers 2. The crease forming unit 202 includes a crease blade 6 and a cradle 7. The crease blade 6 functions as a convex blade, and the cradle 7 functions as a concave blade. The crease forming process is performed on the paper P by inserting the paper between the crease blade 6 (the convex blade) and the cradle 7 (the concave blade). Further, any means that can form the crease in the paper P even without using the convex blade and the concave blade can be used as the crease forming unit 202. The folding device 300 includes a pair of conveying rollers 3, a pair of conveying rollers 4, a pair of conveying rollers 5, a pair of folding rollers 9, a deck (a rear end fence) 11, a folding blade (a folding unit) 8, a processing unit 10, and a stacking unit 12. Hereinafter, it is assumed that a conveying direction of an n-th sheet of paper $P_n$ (here, n is a natural number) is an X2-X1 direction, and a height direction (a moving direction of the crease blade 6) is a Z2-Z1 direction.

FIGS. 3 to 13 are views illustrating the main processing flow of a crease forming process and a folding process. After the crease is formed in the crease forming device 200, the paper is conveyed to the folding device 300 residing at the downstream side. The folding process is performed on the paper conveyed by the folding device 300. The folding process is a process of folding the paper in two.

Figure 3:
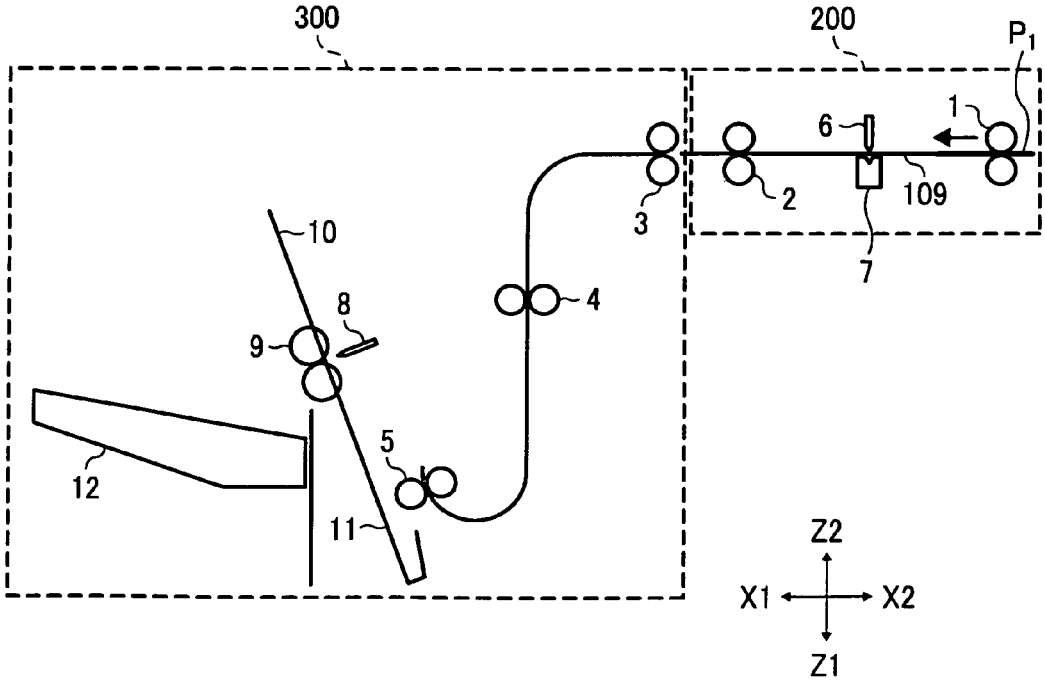
FIG. 3 is a view for explaining the flow of a crease forming process and a folding process (first)

As illustrated in FIG. 3, a first sheet of paper $P_1$ passing through out the image forming process is conveyed by the conveying unit 109 until a crease forming portion of the paper $P_1$ in which a crease is to be formed is located at a position S (hereinafter, referred to as "crease forming position S") at which the creasing forming portion of the paper $P_1$ faces the crease blade 6.

Figure 4:
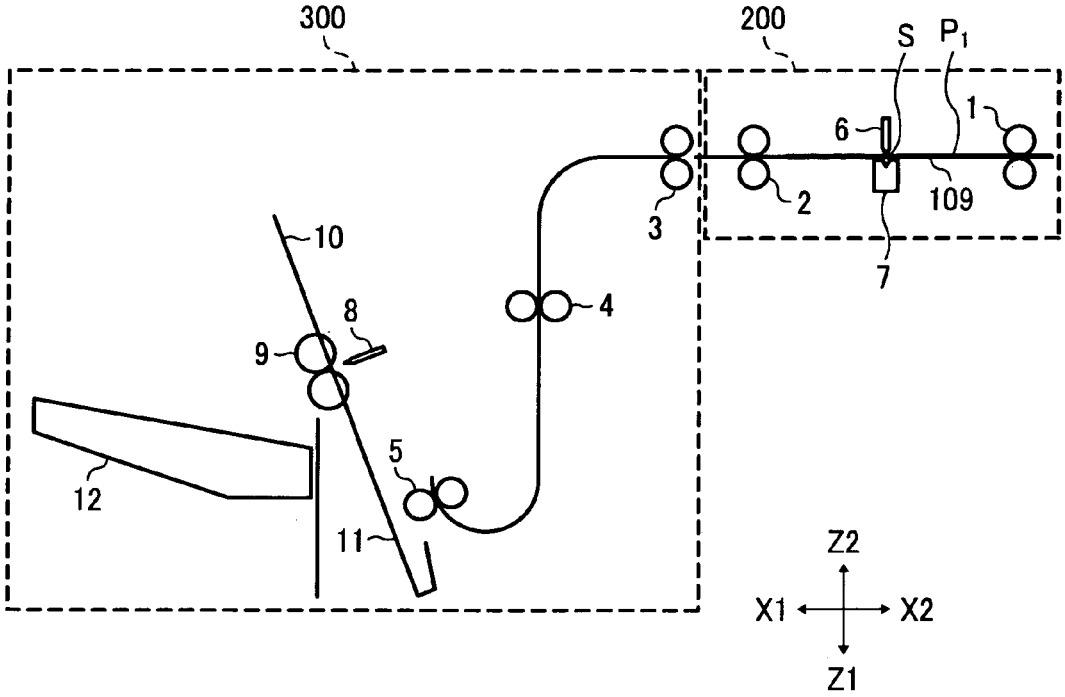
FIG. 4 is a view for explaining the flow of a crease forming process and a folding process (second)
Figure 5:
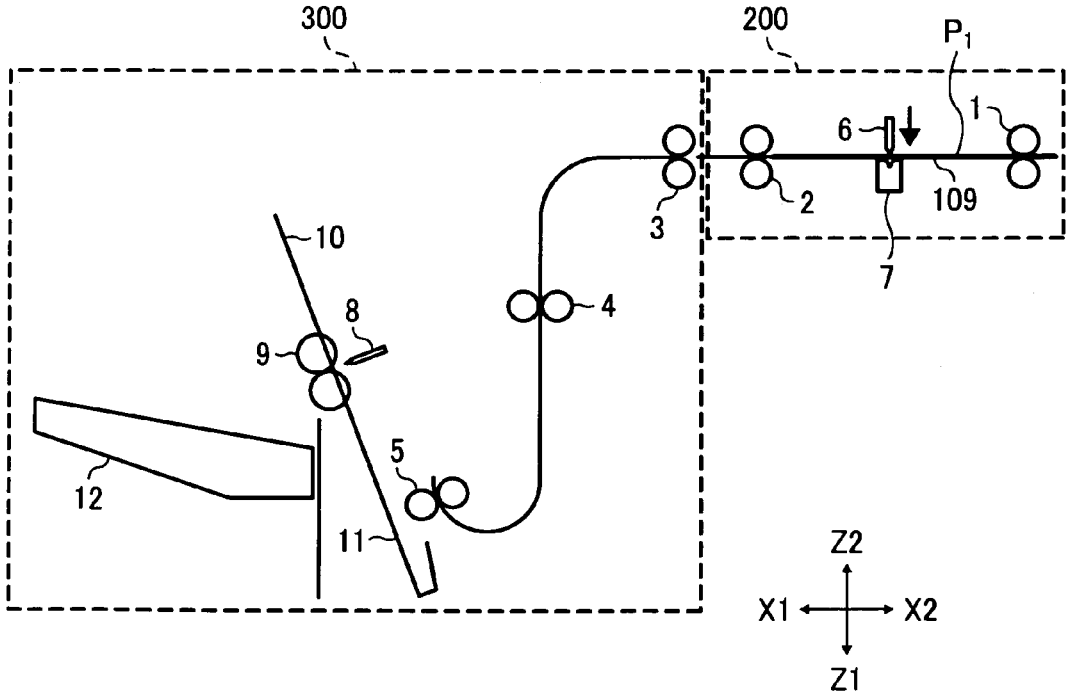
FIG. 5 is a view for explaining the flow of a crease forming process and a folding process (third)

Then, as illustrated in FIG. 4, the paper $P_1$ stops at the creasing forming position S. When the paper $P_1$ stops at the crease forming position S, as illustrated in FIG. 5, the crease blade 6 moves in a direction (a Z1 direction) getting closer to the paper $P_1$ and presses the crease forming portion of the paper $P_1$ to thereby form a crease in the paper $P_1$ (the crease forming process is performed).

Figure 6:
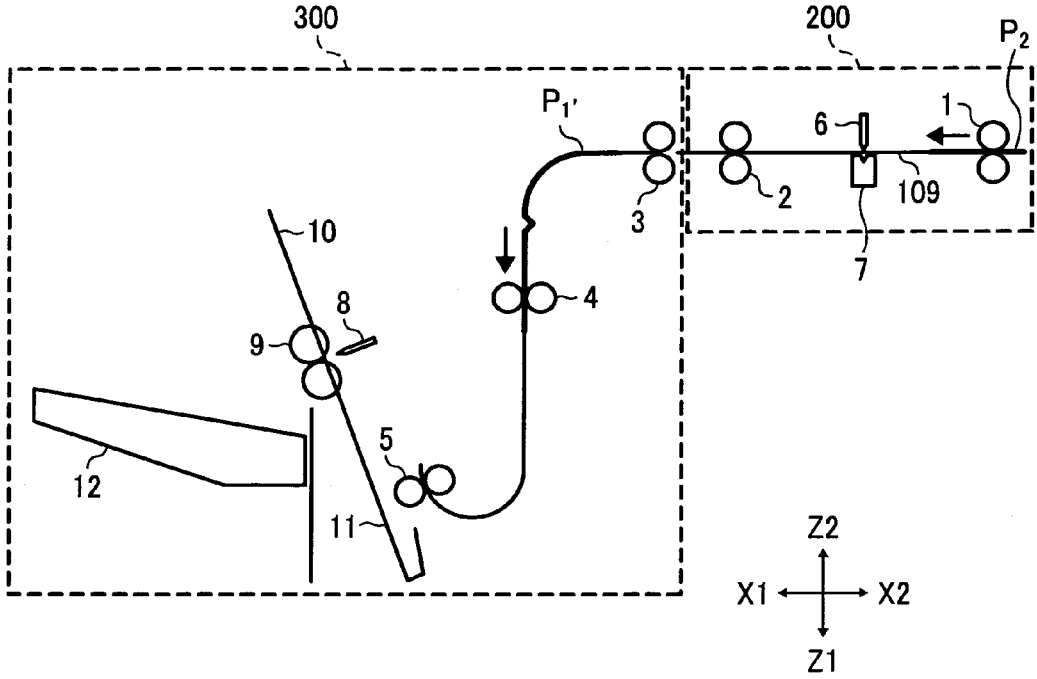
FIG. 6 is a view for explaining the flow of a crease forming process and a folding process (fourth)
Figure 7:
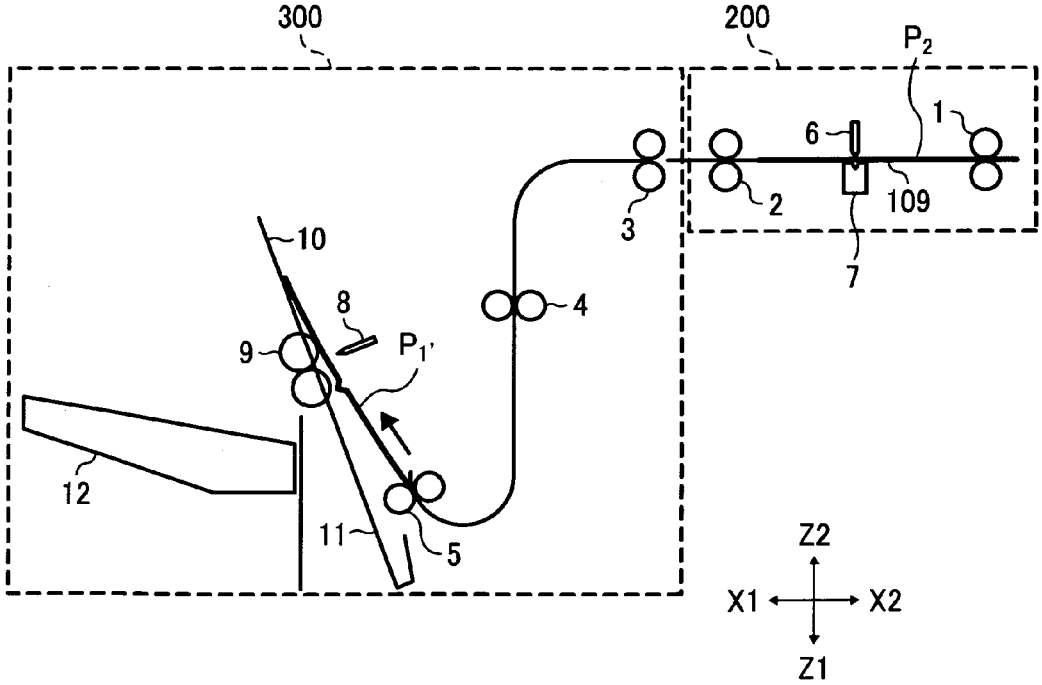
FIG. 7 is a view for explaining the flow of a crease forming process and a folding process (fifth)
Figure 8:
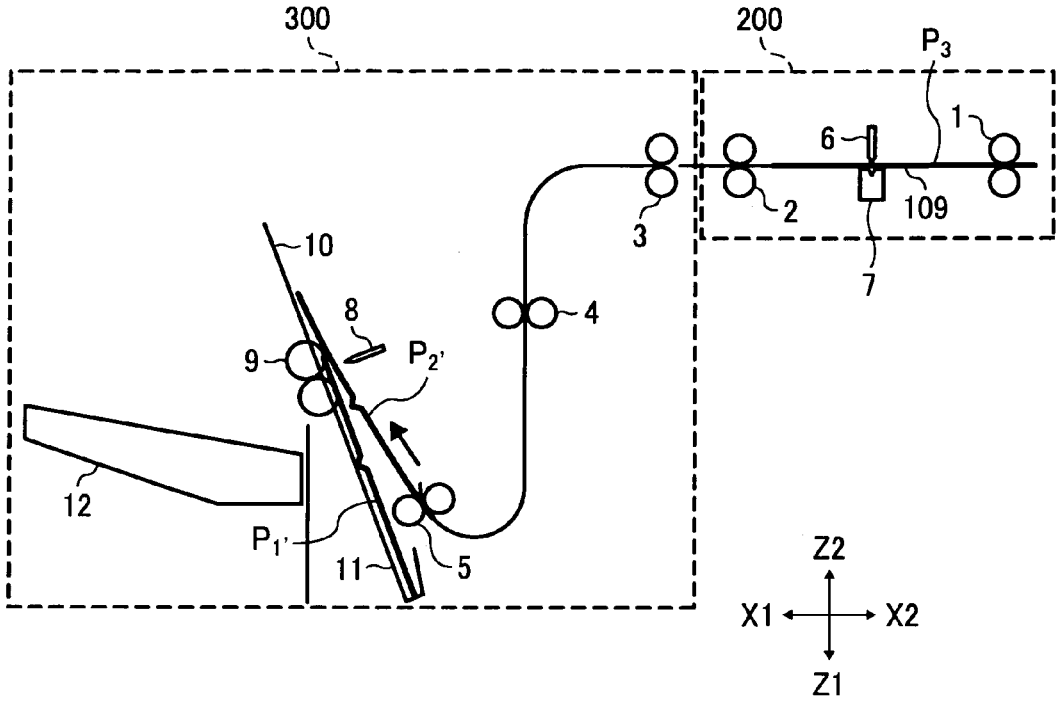
FIG. 8 is a view for explaining the flow of a crease forming process and a folding process (sixth)

Thereafter, as illustrated in FIG. 6, the first sheet of paper $P_1'$ with the crease is conveyed to the folding device 300 by the conveying unit 109. At the same time, a second sheet of paper $P_2$ passing through out the image forming process is conveyed to the crease forming device 200. Then, as illustrated in FIG. 7, the first sheet of paper $P_1'$ with the crease is conveyed to the processing unit 10, and the second sheet of paper $P_2$ is conveyed to the crease forming position S, and the crease is formed. As illustrated in FIG. 8, the paper $P_1'$ is received in the deck 11 and the second sheet of paper $P_2'$ with the crease is conveyed to the processing unit 10. At the same time, a third sheet of paper $P_3$ is conveyed to the crease forming position S, and the crease is formed in the third sheet of paper.

Figure 9:
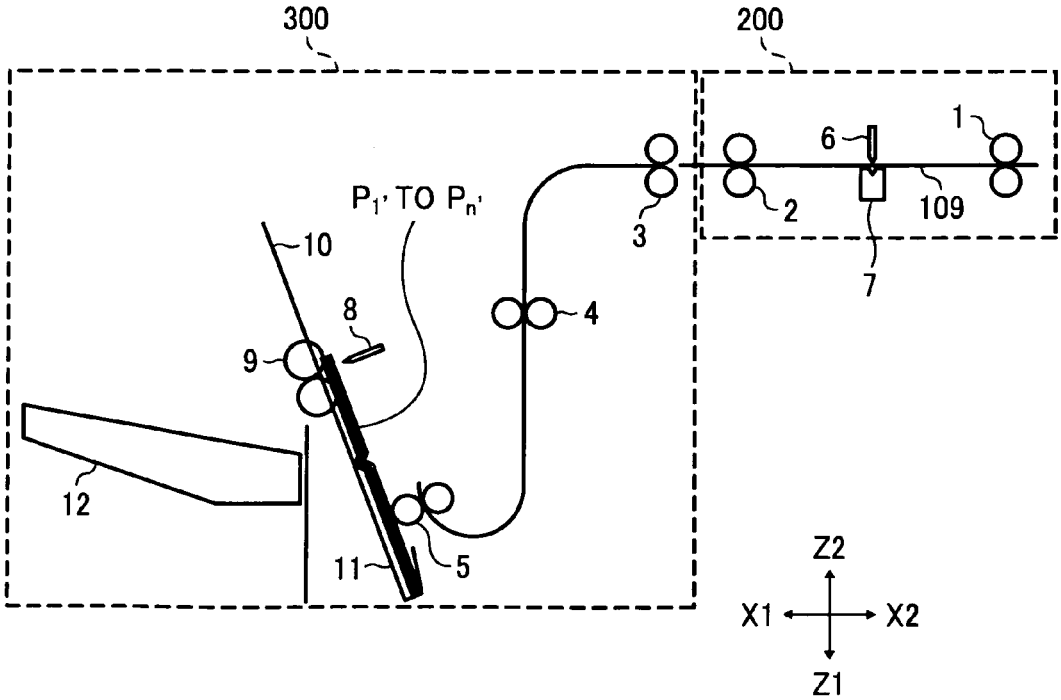
FIG. 9 is a view for explaining the flow of a crease forming process and a folding process (seventh)
Figure 10:
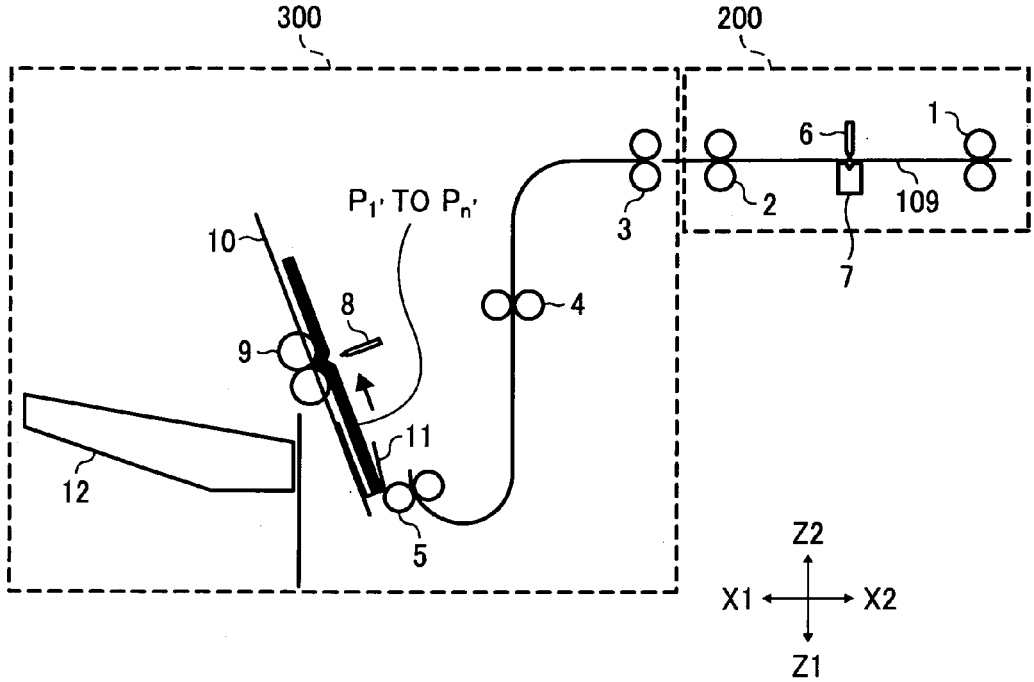
FIG. 10 is a view for explaining the flow of a crease forming process and a folding process (eighth)
Figure 11:
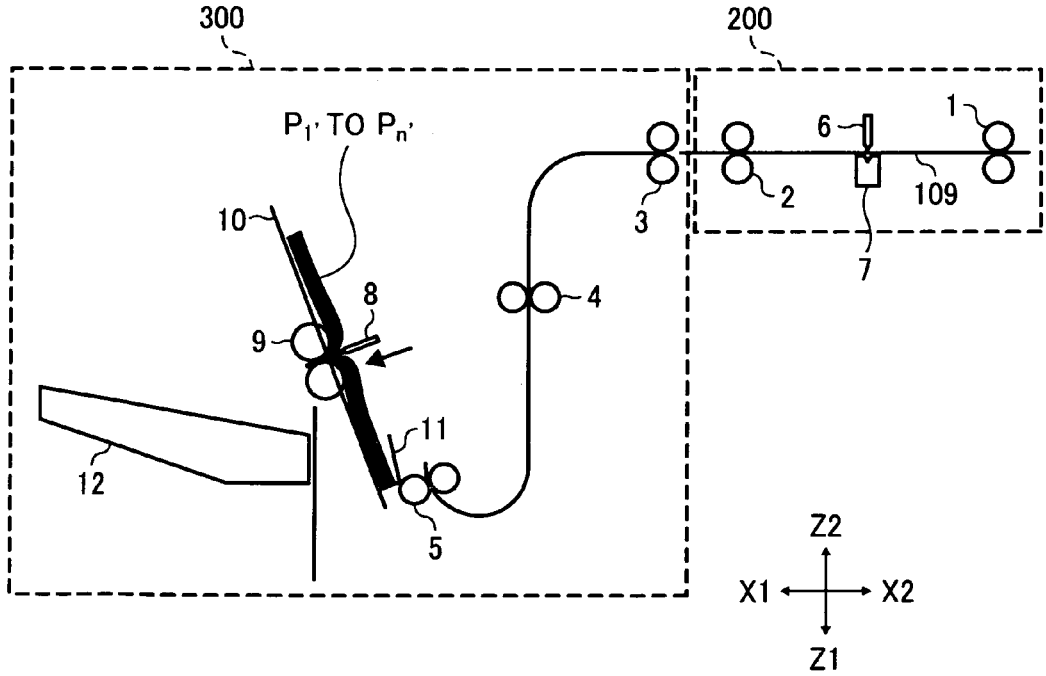
FIG. 11 is a view for explaining the flow of a crease forming process and a folding process (ninth)
Figure 12:
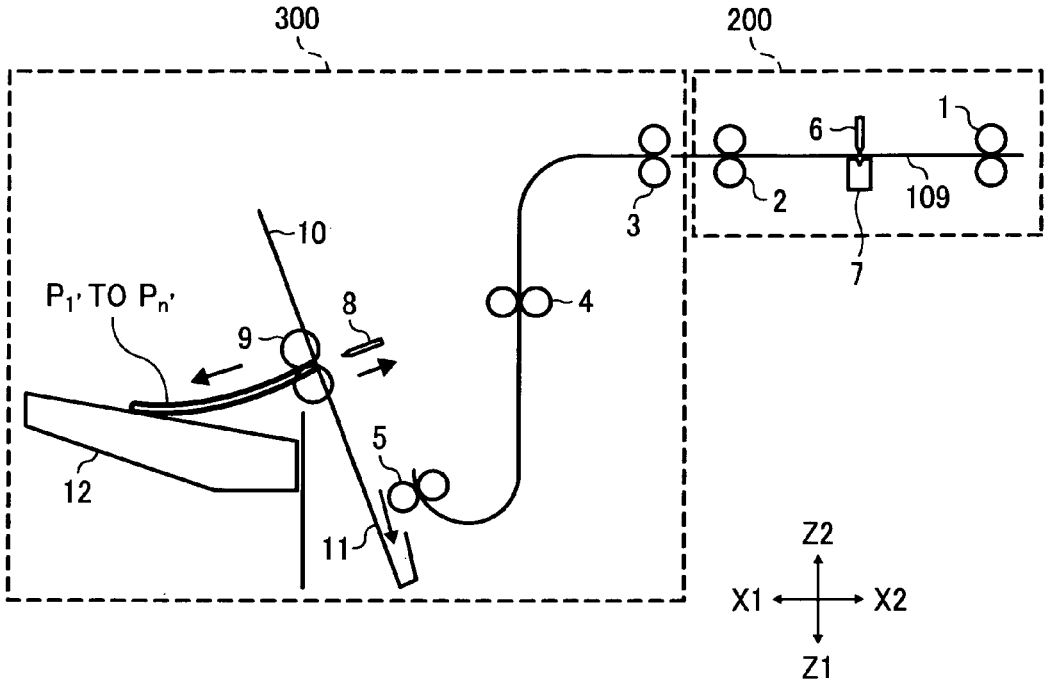
FIG. 12 is a view for explaining the flow of a crease forming process and a folding process (tenth)
Figure 13:
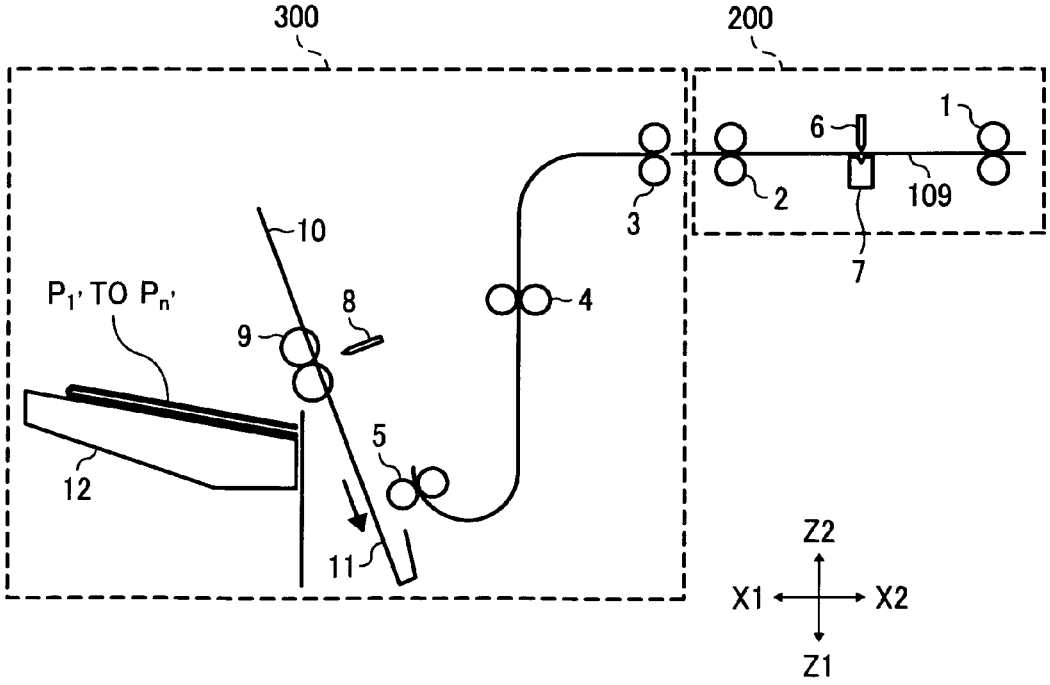
FIG. 13 is a view for explaining the flow of a crease forming process and a folding process (eleventh)

Then, as illustrated in FIG. 9, n sheets of paper $P_1'$ to $P_n'$ with the crease formed therein are received in the deck 11. As illustrated in FIG. 10, the rear end fence 11 serving as the deck moves upward (moves in the Z2 direction), and so the n sheets of paper are conveyed to a position (hereinafter, referred to as "folding position T") at which a folding blade 8 faces the folding portions of the n sheets of paper $P_1'$ to $P_n'$ (that is, the portions in which the creases are formed). Then, as illustrated in FIG. 11, the folding process is performed in a manner such that the folding blade 8 positioned at a home position presses the folding portions of the paper $P_1'$ to $P_n'$ so that the folding portions are inserted into a nip between the pair of folding rollers 9. As illustrated in FIG. 12, the folding blade 8 returns to the home position. Then, as illustrated in FIG. 13, sheets of a book-like paper bundle passing through out the folding process are sequentially stacked on the stacking unit 12.

Details of the Crease Forming Unit

Figure 14:
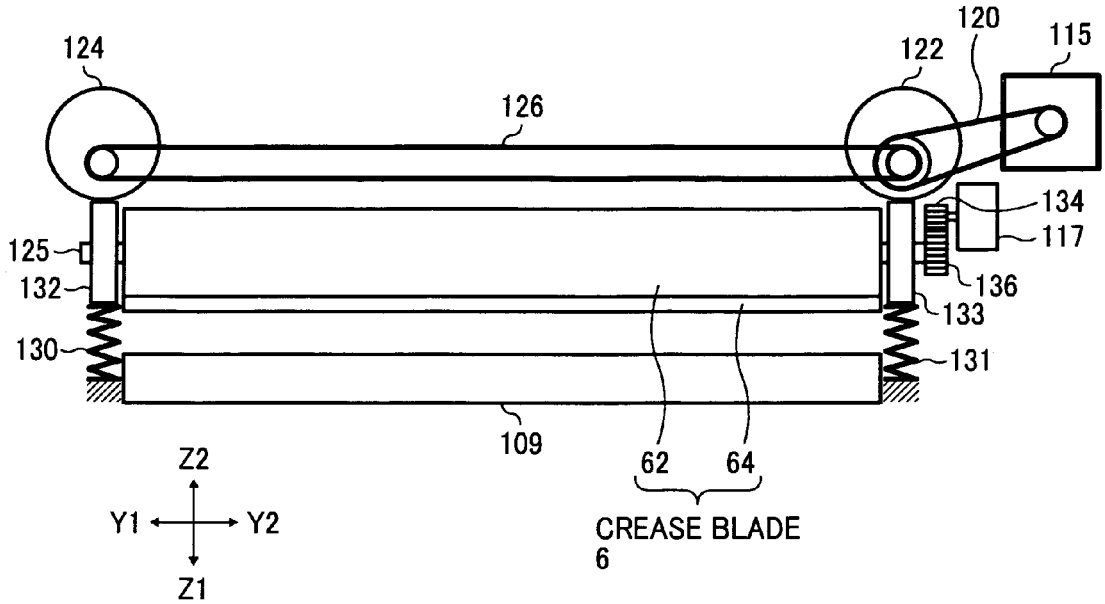
FIG. 14 is a plane view of a crease blade.
Figure 15:
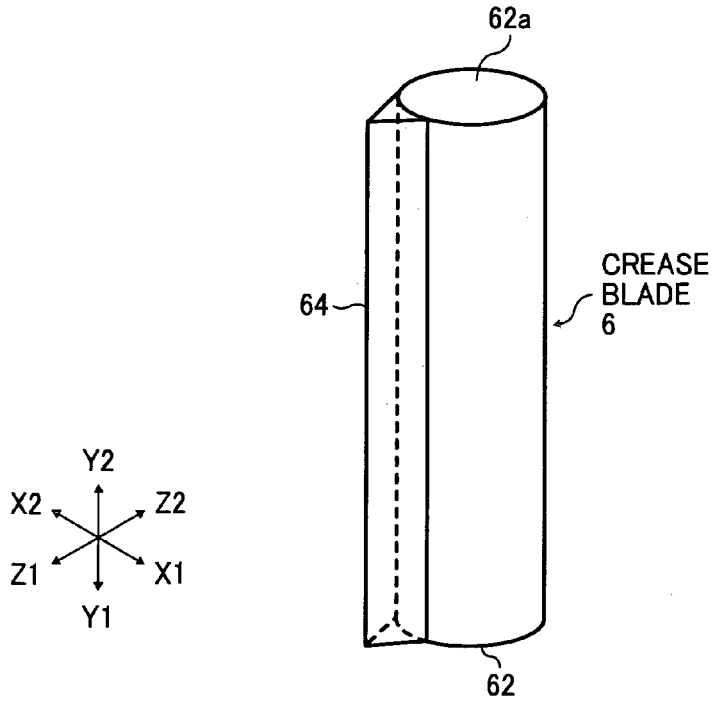
FIG. 15 is a perspective view of a crease blade.

FIG. 14 illustrates a driving mechanism of the crease forming unit 202. A direction in which the crease is formed in the paper is an Y2-Y1 direction. The crease forming unit 202 includes a first driving unit 115 and a second driving unit 117 in addition to the crease blade 6. The crease blade 6 includes a rotator 62 and a blade portion 64. FIG. 15 is a perspective view of the crease blade 6. The rotator 62 has, for example, a circular cylindrical shape. The blade portion 64 is formed on a circumferential surface of the circular cylindrical shape along a longitudinal direction of the circular cylindrical shape. The blade portion 64 has an approximate triangular prism shape. The longitudinal direction length of the blade portion 64 is equal to the longitudinal direction length of the rotator 62.

As illustrated in FIG. 14, swinging members 132 and 133 are disposed at both ends of the rotator 62 in the longitudinal direction. In this example, the swinging members 132 and 133 have an approximate disc shape. Elastic members 130 and 131 are disposed at both ends of the conveying unit 109 in the width direction (that is, the Y2-Y1 direction, in other words the longitudinal direction of the rotator 62), respectively. The swinging members 132 and 133 are held by the elastic members 130 and 131, respectively in a rotatable manner, and elastically biased by the elastic members 130 and 131 in a direction getting away from the conveying unit 109.

The swinging members 132 and 133 abut on eccentric cams 122 and 124, respectively. A driving unit (a driving belt) 126 is stretched over the two eccentric cams 122 and 124, and the two eccentric cams 122 and 124 can integrally rotate. The eccentric cam 122 is connected to a driving unit (a driving belt) 120. Driving force from the first driving unit 115 (for example, a driving motor) is transmitted via the driving belt 120 and the driving belt 126, so that the eccentric cams 122 and 124 come to rotate. As the eccentric cams 122 and 124 rotate, the swinging members 132 and 133 (that is, the crease blade 6) are elastically biased by the elastic members 130 and 131 and move in an up-down direction. The up-down direction is a direction getting closer to or getting away from the conveying unit 109. Hereinafter, what the crease blade 6 moves upward means that the crease blade 6 moves in a direction getting away from the conveying unit 109. Conversely, what the crease blade 6 moves downward means that that the crease blade 6 moves in a direction getting closer to the conveying unit 109.

Figure 16:
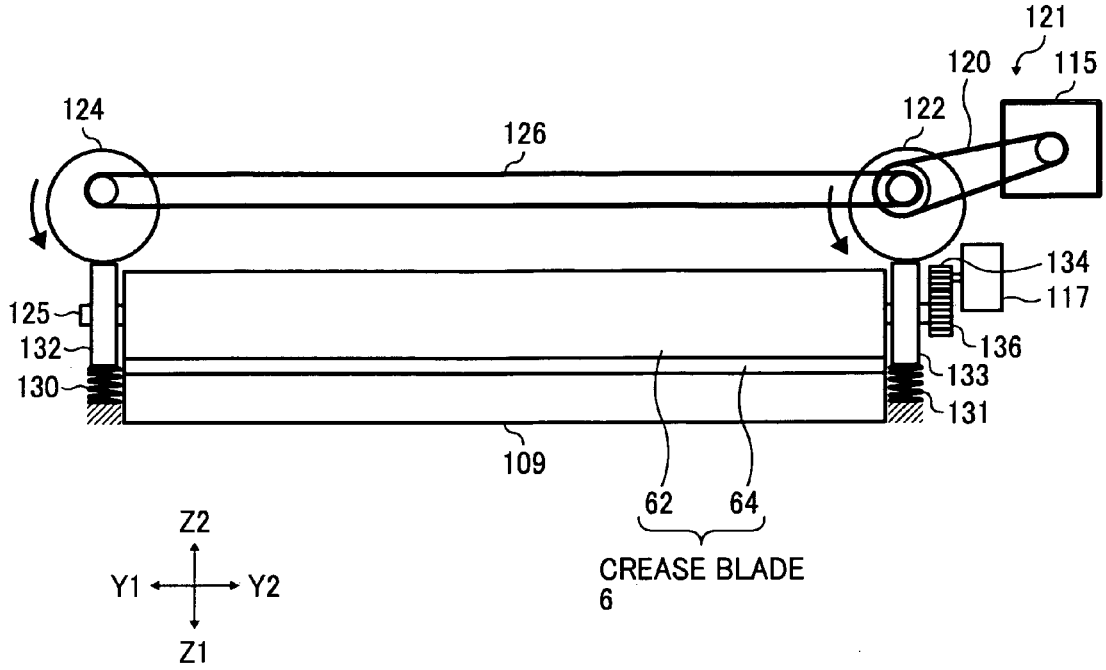
FIG. 16 is a view illustrating the case in which a crease blade has moved down.

FIG. 16 illustrates the case in which the crease blade 6 has moved down. When the crease blade 6 has moved down, the blade portion 64 comes to press the paper P and form the crease in the paper.

Figure 17:
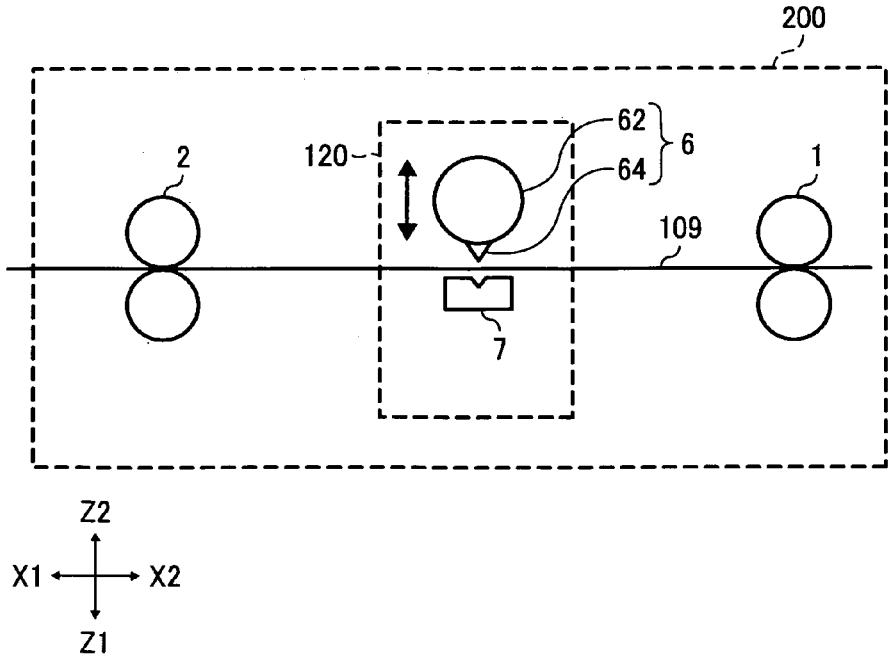
FIG. 17 is a view illustrating a crease blade viewed from an angle different from FIG. 14.

FIG. 17 illustrates the crease blade 6 viewed from a plane surface 62*a* side (see FIG. 15) of the rotator 62. As illustrated in FIG. 17, the crease blade 6 moves upward or downward according to the driving of the first driving unit 115.

As illustrated in FIG. 14, the rotator 62 is pivotably supported on a rotational shaft 125. A gear 136 is mounted on one end of the rotational shaft 125. The swinging member 133 is interposed between the gear 136 and the rotator 62. The gear 136 is meshed with a gear 134. The gear 134 is connected to the second driving unit (the driving motor) 117, so that the gear 134 is rotatably driven according to the driving of the second driving unit 117. When the gear 134 rotates, the gear 136, the rotational shaft 125, and the rotator 62 also integrally rotate.

Figure 18:
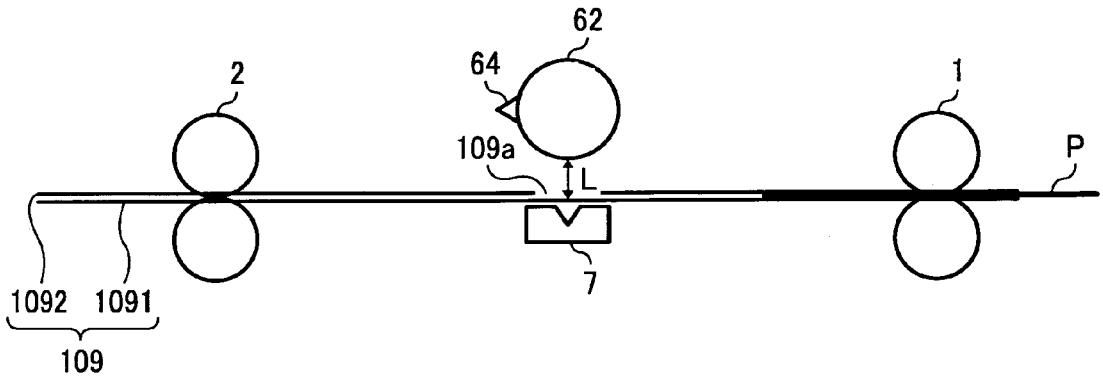
FIG. 18 is a view for explaining an operation of a crease blade (first)
Figure 19:
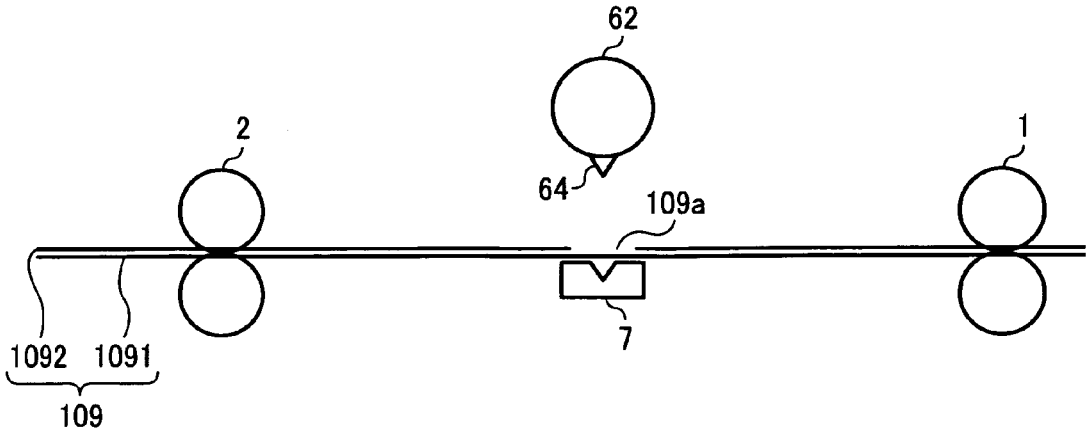
FIG. 19 is a view for explaining an operation of a crease blade (second)

FIGS. 18 and 19 illustrate a rotational motion of the crease blade 6 (the rotator 62). The crease blade 6 rotates to a position where the blade portion 64 does not face the conveying unit 109 as illustrated in FIG. 18 or rotates to a position where the blade portion 64 faces the conveying unit 109 as illustrated in FIG. 19. The rotational motion of the crease blade 6 is performed at a distance of a predetermined interval L from the conveying unit 109 as illustrated in FIGS. 18 and 19. Hereinafter, a position of the crease blade 6 in which the blade portion 64 does not face the conveying unit 109 is referred to as a home position.

Structure of the Crease Forming Device 200

Figure 20:
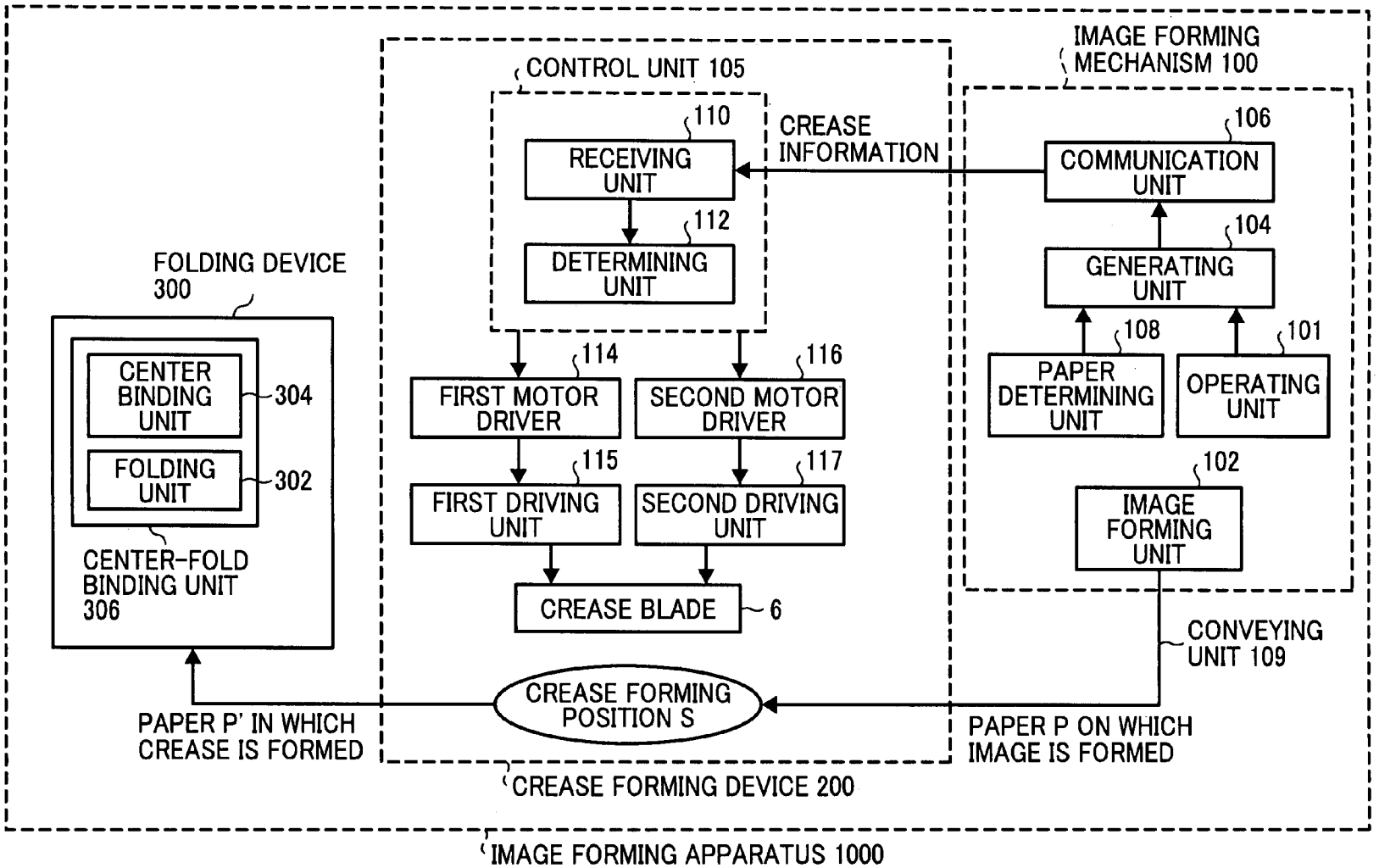
FIG. 20 is a view illustrating an exemplary functional structure of a crease forming device.

FIG. 20 illustrates the hardware structure of an image forming apparatus 1000 having the crease forming device 200 according to the embodiment. As illustrated in FIG. 20, the image forming apparatus 1000 of the present embodiment includes the crease forming device 200, an image forming mechanism 100, and the folding device 300. In the example of FIG. 20, the crease forming device 200 includes a control unit 105, a first motor driver 114, the first driving unit 115, a second motor driver 116, the second driving unit 117, and the crease blade 6. The control unit 105 includes a receiving unit 110 and a determining unit 112. The image forming mechanism 100 mainly forms an image on the paper.

Further, the crease forming device 200 of the present embodiment does not form the crease in predetermined paper and conveys the predetermined paper to the folding device 300. Whether to form the crease in the paper through the crease forming device 200 is determined by the determining unit 112, based on crease information.

Figure 30:
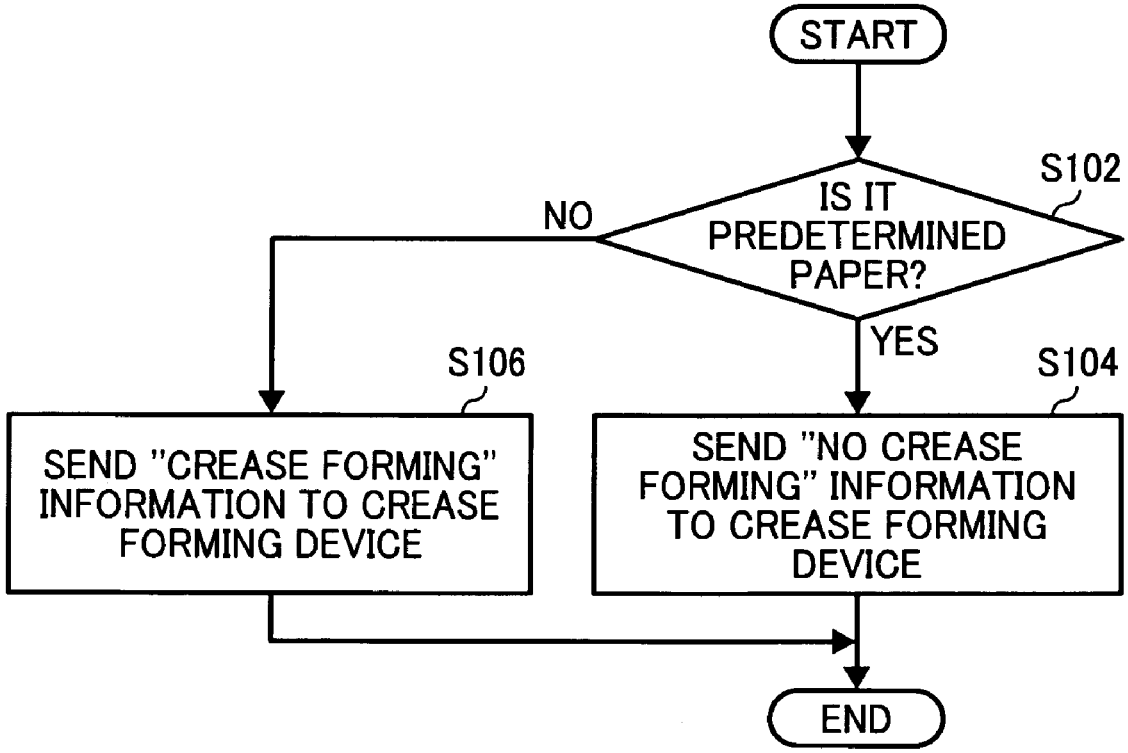
FIG. 30 is a view illustrating a process flow for generating crease forming information.

A generating unit 104 in the image forming mechanism 100 generates the crease information. FIG. 30 illustrates a process flow of generating the crease information through the generating unit 104. The crease information is information representing whether to form the crease in the recording medium (the paper P). First, the generating unit 104 determines whether the paper on which an image is to be formed by an image forming unit 102 is the predetermined paper. "kinds of the predetermined paper" or "a method of determining the predetermined paper" will be described later. When the generating unit 104 determines that it is the predetermined paper (Yes at step S102), the process proceeds to step S104.

In step S104, the generating unit 104 generates the information "no crease forming" as the crease information. The information "no crease forming" is information representing that the crease is not to be formed in the paper. The information "no crease forming" generated is transmitted to the crease forming device 200 via a communication unit 106 (step S104).

In contrast, when the generating unit 104 determines that it is not the predetermined paper (No at step S102), the process proceeds to step S106.

In step S106, the generating unit 104 generates information "crease forming" as the crease information. The information "crease forming" is information representing that the crease is to be formed in the paper. The information "crease forming" generated is transmitted to the crease forming device 200 via the communication unit 106 (step S106).

When the receiving unit 110 receives the crease information, the determining unit 112 determines whether to form the crease in the paper based on the crease information (the information "crease forming" or the information "no crease forming"). That is, when it is determined that the crease information is the information "no crease forming" (information representing that the crease is not to be formed in the paper), the determining unit 112 determines that, the crease is not to be formed in the paper. Further, when it is determined that the crease information is the information "crease forming" (information representing that the crease is to be formed in the paper), the determining unit 112 determines that the crease is to be formed in the paper.

The control unit 105 controls the first motor driver 114 to drive the first driving unit 115 (see FIG. 14) and controls the second motor driver 116 to drive the second driving unit 117 (see FIG. 14). As described above, when the first driving unit 115 is driven, the crease blade 6 moves in the up-down direction (the Z1-Z2 direction) (see FIGS. 14 to 16), and when the second driving unit 117 is driven, the crease blade 6 rotates (see FIGS. 18 and 19).

Further, as illustrated in FIGS. 18 and 19, the conveying unit 109 of the present embodiment includes two guide members 1091 and 1092. The paper P on which an image has been formed is held between the guide members 1091 and 1092 and conveyed by conveying force applied from a convey means (not shown). Further, a cutout portion 109*a* is formed in the conveying unit 109. When the crease blade 6 moves toward the conveying unit 109, the blade portion 64 passes through the cutout portion 109*a* to thereby form the crease in the paper P.

Figure 21:
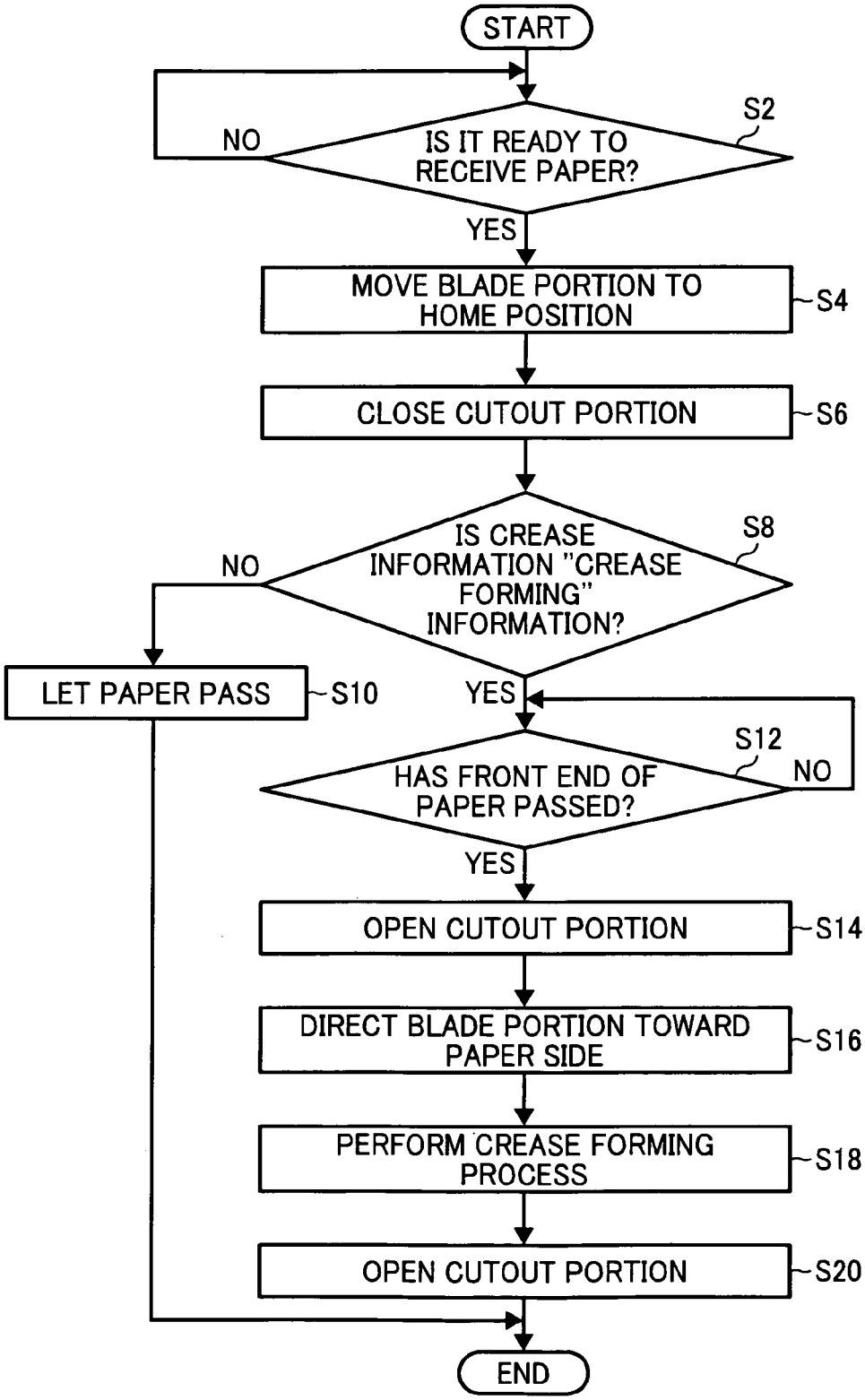
FIG. 21 is a view illustrating a process flow in a crease forming device.

FIG. 21 illustrates a process flow of the crease forming device 200. The process of the crease forming device 200 will be described with reference to FIGS. 20 and 21. When the image forming process is performed on the paper P by the image forming unit 102 in the image forming mechanism 100, the control unit 105 determines whether or not the crease forming device 200 is ready to receive the paper (step S2). When the control unit 105 determines that the crease forming device 200 is ready to receive the paper (Yes at step S2), the paper P on which an image has been formed is conveyed to the crease forming position S by the conveying unit 109 (see. FIG. 2). When the control unit 105 determines that the crease forming device 200 is not yet ready to receive the paper (No at step S2), the paper is on standby until the crease forming device 200 becomes ready to receive the paper.

Next, the control unit 105 moves the blade portion 64 of the crease blade 6 to the home position (in the direction in which the blade portion 64 does not face the conveying unit 109) as illustrated in FIG. 18 (step S4). The blade portion 64 is moved to the home position by driving the second driving unit 117 through the control unit 105 as described above (see FIG. 14).

Figure 22:
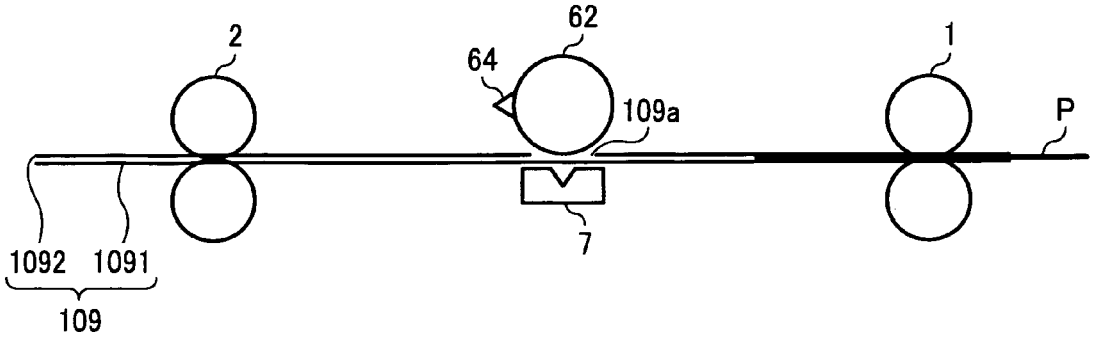
FIG. 22 is a view for explaining an operation of a crease blade (third)

Next, as illustrated in FIG. 22, in a state in which the blade portion 64 does not face the conveying unit 109 side, the crease blade 6 moves down, so the rotator 62 of the crease blade 6 comes to close the cutout portion 109*a* of the conveying unit 109 (step S6). The reason of closing the cutout portion 109*a* is because the front end of the paper P is likely to be caught in the cutout portion 109*a* from time to time. When the determining unit 112 determines at step S3 that the crease forming process is not to be performed (No at step S8), the conveying unit 109 makes the paper pass by the crease blade 6 without undergoing the crease forming process and further conveys the paper to the folding device 300.

Next, a determining unit 112 determines which of the crease information between the information "crease forming" or the information "no crease forming" is received (step S8). In other words, the determining unit 112 determines whether or not the paper is the "predetermined paper." When the determining unit 112 determines that the crease information is the information "crease forming" (that is, determines that the paper is not the "predetermined paper") (Yes at step S8), the process proceeds to step S12.

In contrast, when the determining unit 112 determines at step S8 that the crease information is the information "no crease forming" (that is, determines that the paper is the "predetermined paper") (No at step S8), the process proceeds to step S10.

In step S12, a front end sensor (not shown) determines whether or not the front end of the paper passed through the cutout portion 109*a* (step S12). When the front end sensor determines that the front end of the paper passed through the cutout portion 109*a* (Yes at step S12), the process proceeds to step S14. However, when the front end sensor determines that the front end of the paper did not pass through the cutout portion 109*a* (No at step S12), the process returns to step S12.

Figure 23:
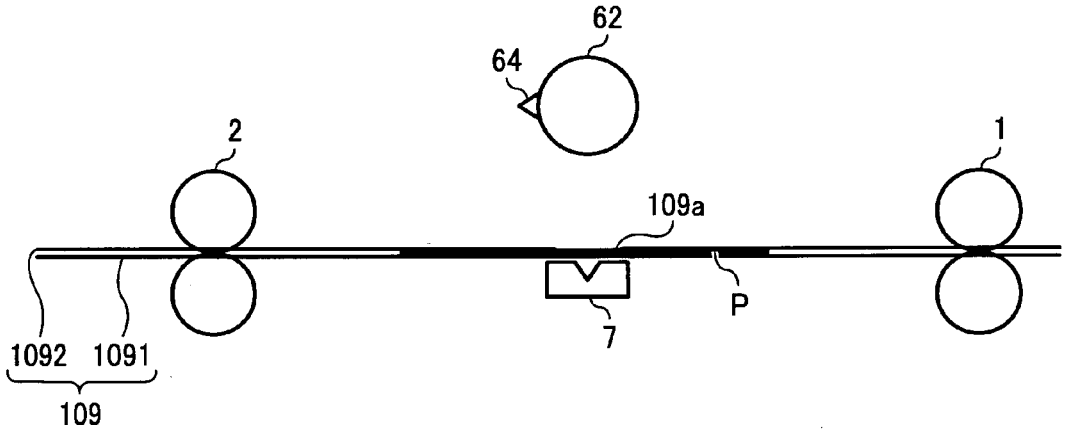
FIG. 23 is a view for explaining an operation of a crease blade (fourth)
Figure 24:
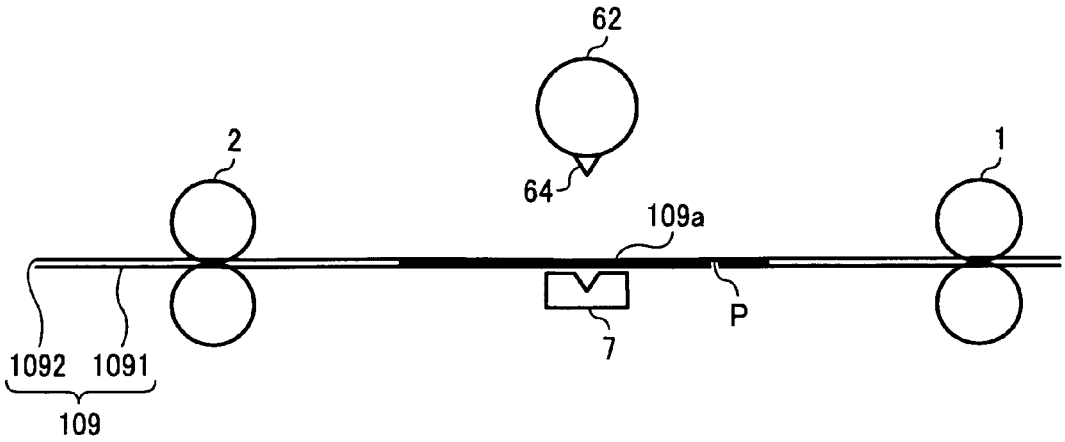
FIG. 24 is a view for explaining an operation of a crease blade (fifth)

Next, as illustrated in FIG. 23, the crease blade 6 opens the cutout portion 109*a* (step S14). That is, the control unit 105 moves the crease blade 6 up. Next, as illustrated in FIG. 24, the control unit 105 rotates the crease blade 6 so that the blade portion 64 comes to face the conveying unit 109 (the paper P) (step S16). Rotation of the crease blade 6 is performed by driving the second driving unit 117 through the control unit 105 as described above.

Figure 25:
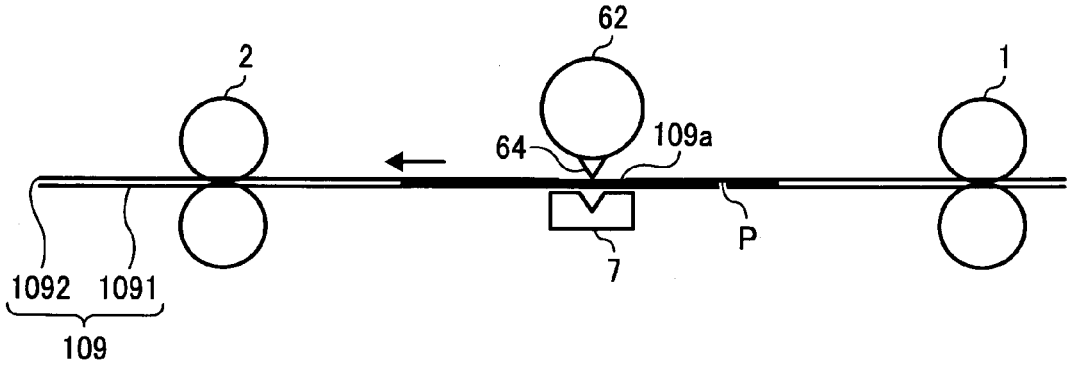
FIG. 25 is a view for explaining an operation of a crease blade (sixth)
Figure 26:
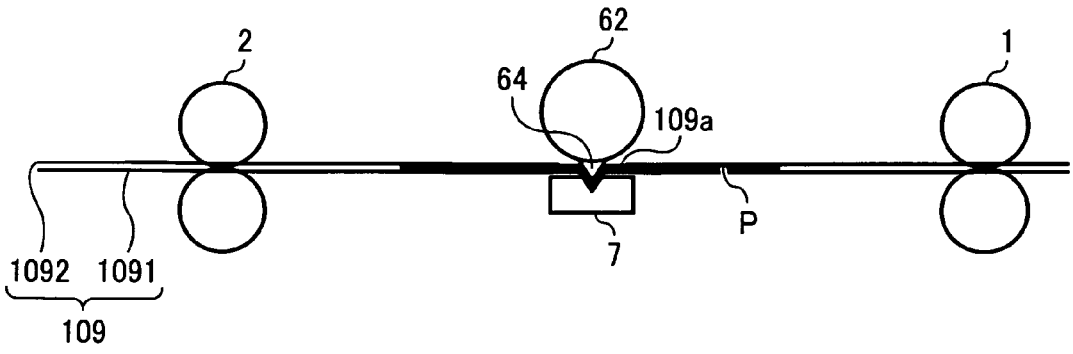
FIG. 26 is a view for explaining an operation of a crease blade (seventh)

Then, as illustrated in FIG. 25, the control unit 105 moves the crease blade 6 down in a state in which the blade portion 64 faces the paper P. As illustrated in FIG. 26, the control unit 105 performs the crease forming process by pressing the blade portion 64 against the paper P (step S18). Thereafter, as illustrated in FIG. 19, the crease blade 6 is moved up again to open the cutout portion 109*a* (step S20). At the same time, the paper P in which the crease is formed is conveyed to the folding device 300.

Further, at step S10, the crease forming process is not performed on the paper P, and the paper P passes as is through the crease forming unit.

As described above, when the crease information is the information "no crease forming" (that is, the information representing that the crease is not to be formed), as in the flow of No at step S8 and step S10, the control unit 105 prohibits the crease forming process from being performed by the crease forming unit 202 (the crease forming unit 202 let the paper pass therethrough without forming the crease in the paper P). Further, when the crease information is the information "crease forming" (that is, the information representing that the crease is to be formed), as in the flow of step S12 to step S20, the crease forming unit 202 performs the process of forming the crease in the paper P.

Next, concrete examples of the "predetermined paper" will be described.

(1) Formation of a Single Color Image

If the predetermined paper P is paper on which a single color image is to be formed by the image forming unit 102, the generating unit 104 may determine that the crease forming device 200 does not form the crease. Here, formation of a single color image means that the image forming unit 102 forms an image in a single color, for example, cyan, magenta, yellow, or black. When an image in a single color is formed, the thickness of ink attached to the paper is thin, as compared with the case in which an image in a combination color is formed. It is because the combination color is formed by superimposing plural single-color inks. If the thickness of ink is thin, even when the folding process is performed, an image is not nearly peeled off. For the paper on which a single color image is formed, the generating unit 104 generates the crease information representing that the crease is not to be formed in the paper (the information "no crease forming"), and thus the crease forming device 200 does not form the crease. In contrast, for the paper on which the combination color image is formed, the generating unit 104 generates the information "crease forming."

Further, for the paper on which an image is formed with a single color of black (that is, when a black image is formed), even if an image is peeled off, it is difficult to visually recognize a crack of an image caused by image peeling with eyes. Therefore, as for the formation of an image in a single color, particularly for the paper on which an image in a single color of black is formed, the crease forming device 200 generally does not form the crease.

Information as to whether or not a single color image is formed or information as to whether or not an image in a single color of black is formed is input through an operating unit 101 by a user.

(2) Stretch Property

When the predetermined paper is a recording medium (paper) having a stretch property, the crease forming device 200 may not perform the crease forming process. The paper having the stretch property includes, for example, a film coat. When the paper P does not have the stretch property, since the surface of the paper is not stretched in the mountain portion $P_a$ or the valley portion $P_b$ (see FIGS. 1A and 1B) of the crease of the paper P, an image is peeled off. However, if the paper P has the stretch property, when the paper P is folded, since the surface of the paper is stretched in the mountain portion $P_a$ or the valley portion $P_b$, an image is hardly peeled off. Therefore, for the paper having the stretch property, the generating unit 104 generates the crease information representing that the crease is not to be formed in the paper (the information "no crease forming"), so the crease forming device 200 does not form the crease.

Further, information as to whether or not the paper has the stretch property may be input through the operating unit 101 by the user. Alternatively, a determining unit 108 in the image forming mechanism may check the type of paper and determine whether or not the paper has the stretch property according to the type of paper. The operating unit 101 or the determining unit 108 notifies the generating unit 104 of information as to whether or not the paper has the stretch property. The generating unit 104 generates the crease information based on the information as to whether or not the paper has the stretch property. That is, when the paper has the stretch property, the generating unit 104 generates the information representing that the crease is not to be formed (the information "no crease forming"). In contrast, when the paper does not have the stretch property, the generating unit 104 generates the information representing that the crease is to be formed (the information "crease forming").

(3) Open Angle

The recording medium that was subjected to the crease forming process performed by the crease forming device 200 (or alternatively, the recording medium that was not subjected to the crease forming process) is conveyed to the folding device (the folding unit) 300. For example, in the examples of FIGS. 10 to 13, the folding device 300 performs a superimposing-folding process (a folding process) on the n papers.

Figure 1B:
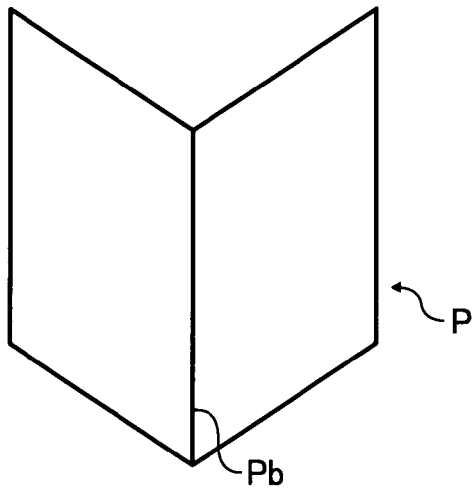

Here, when an open angle θ (see FIG. 1A) of the paper folded by the folding device 300 is larger than a previously determined threshold, the crease forming device 200 of the present embodiment may not perform the crease forming process on all the sheets of paper. It is because when the open angle θ is large, since the surface tension of the paper in the mountain portion Pa and in the valley portion Pb of the crease is weak, an image is hardly peeled off. In this example, the open angle θ represents an acute angle among open angles of the paper folded by the folding process as illustrated in FIG. 1A. The open angle θ depends on the number of sheets of paper and the thickness of paper to be folded by the folding device 300.

The number of sheets of paper to be folded is input through the operating unit 101 by the user. The thickness of the paper is determined by the determining unit 108. The operating unit 101 transmits information of the number of sheets of the paper to the generating unit 104, and the determining unit 108 transmits information of the thickness of the paper to the generating unit 104. The generating unit 104 computes the open angle θ of the folded paper based on the number of sheets of the paper and the thickness of the paper. The generating unit 104 compares the computed open angle θ with the previously determined threshold $\theta_{th}$. When the open angle θ is equal to or greater than the threshold $\theta_{th}$, the generating unit 104 generates the crease information representing that the crease is not to be formed (the information "no crease forming"). When the open angle θ is less than the threshold $\theta_{th}$, the generating unit 104 generates the crease information representing that the crease is to be formed (the information "crease forming").

All sheets of paper may have the same thickness. Therefore, the crease forming device 200 may determine whether to form the crease based on the number of sheets of the paper (the number of the recording media). As the number of sheets of paper increases, the opening angle θ increases. Therefore, when the predetermined recording media is a recording medium included in the number of sheets of paper, which exceeds the predetermined threshold, to be folded by the folding device 300, the crease forming device 200 may not form the crease in all the sheets of the paper (the generating unit 104 may generate the information representing that the crease is not to be formed). In further detail, the generating unit 104 compares the number of sheets of paper to be printed (to be folded in a superimposing manner) input from the operating unit 101 with the previously determined threshold. When the number of sheets of the paper is greater than the threshold, the generating unit 104 generates the crease information representing that the crease is not to be formed (the information "no crease forming"). However, when the number of sheets of the paper is smaller than the threshold, the generating unit 104 generates the crease information representing that the crease is to be formed (the information "crease forming").

(4) Formation of Book Image

Figure 27A:
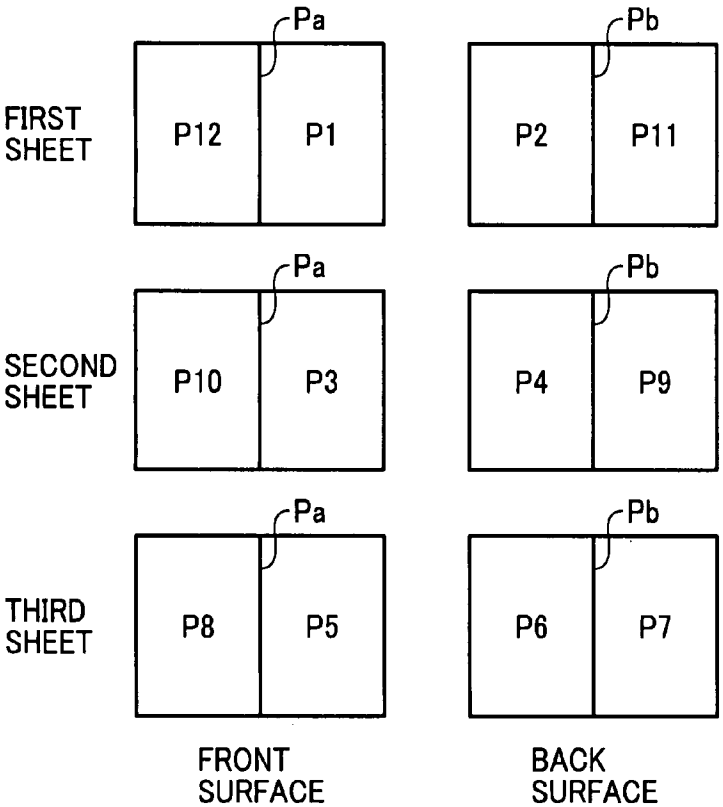
FIG. 27A illustrates paper with images to form a book.
Figure 27B:
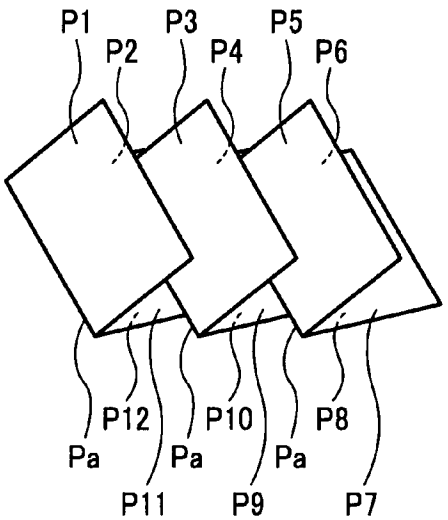
FIG. 27B illustrates center-folded paper.
Figure 27C:
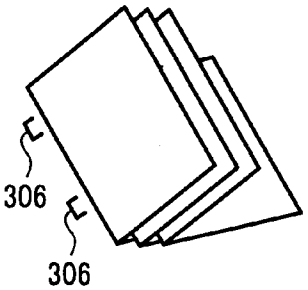
FIG. 27C illustrates center-bound paper.

When the predetermined paper is paper used for forming book image, the crease forming device 200 may not form the crease. Hereinafter, the book image forming is referred to as book printing. FIGS. 27A to 27C illustrate book printing. As illustrated in FIGS. 27A to 27C, the term "book printing" means that when the paper is folded and bound by a binding member (for example, a staple of a stapler) at the center, in order to make a book, both-side printing is performed such that two pages of an original document are printed on each of the front surface and the back surface of the paper in a manner such that the pages are arranged in the right order. That is, the book printing (book image forming) means that the image forming is performed such that images are arranged in an order in which a book can be made. FIGS. 27A to 27C illustrate the case of printing a book of 12 pages.

As illustrated in FIG. 27A, images P1 and P12 are printed on the front surface of a first sheet of paper by the image forming unit 102. Images P2 and P11 are printed on the back surface of the first sheet of paper by the image forming unit 102. Similarly, the image forming unit 102 prints images P3 and P10 on the front surface of a second sheet of paper and images P4 and P9 on the back surface of the second sheet of paper. Similarly, the image forming unit 102 prints images P8 and P5 on the front surface of a third sheet of paper and images P6 and P7 on the back surface of the third sheet of paper.

As illustrated in FIG. 27B, the plural sheets of double-side printed paper are folded at their centers by a folding unit 302 in the folding device 300 (see FIGS. 10 and 12). Next, as illustrated in FIG. 27C, the centers of the sheets of paper superimposed on each other are bound by a binding member (for example, a staple of a stapler) through a center binding unit 304 in the folding device 300, so that a book is completed. The completed book is discharged from the image forming apparatus 1000. Alternatively, the sheets of paper may be discharged from the image forming apparatus 1000 in the state in which they are folded but not bound at their centers by the center binding unit 304 (the state of FIG. 27B).

Here, images are not printed on the valley portion $P_b$ and the mountain portion $P_a$ of the crease of the paper in which book printing was performed. Therefore, even when the paper is folded at the center by the folding unit 302, the image is not peeled off. Therefore, the crease forming device 200 does not form the crease in the paper in which book image forming is to be formed. When book image forming is performed, the generating unit 104 generates the crease information representing that the crease is not to be formed in the paper (the information "no crease forming"). However, when book image forming is not performed, the generating unit 104 generates the crease information representing that the crease is to be formed in the paper (the information "crease forming"). Information as to whether or not the book image forming is performed is input through the operating unit 101 by the user.

(5) Center-Fold Binding

When a center-fold binding unit 306 performs center-fold binding on plural sheets of paper, the crease forming device 200 of the present embodiment may not perform the crease forming process on sheets of paper (hereinafter, referred to as "middle paper (middle recording media)") except of the outermost sheet and the innermost sheet. The center-fold binding unit 306 includes the folding unit 302 and the center binding unit 304 (see FIG. 20). The center-fold binding process performed by the center fold binding unit 306 is a process of folding the paper at the center through the folding unit 302 and binding the center of the folded paper through the center binding unit 304. The center-fold binding process is generally performed, for example, on the paper on which the book printing has been performed, but may be also performed on the paper on which printing has been performed by any other printing techniques. Here, any other printing technique includes a technique of printing a single page on each of the front surface and the back surface rather than printing two pages on each of the front surface and the back surface.

Figure 28A:
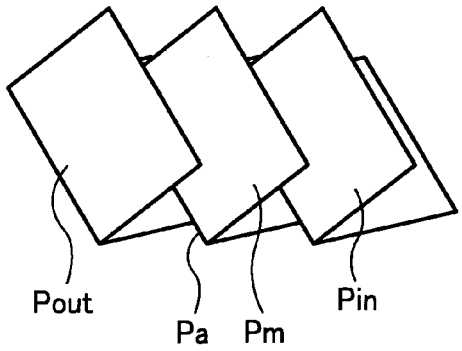
FIG. 28A illustrates center-folded paper.
Figure 28B:
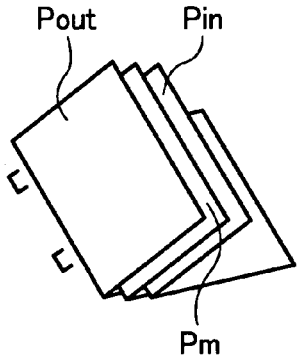
FIG. 28B illustrates center-bound paper.

FIGS. 28A and 28B illustrate sheets of paper that have passed through the center fold binding process. FIG. 28A illustrates the case in which the sheets of paper are folded at their centers by the folding unit 302. FIG. 28B illustrates the case in which the sheets of center-folded paper are bound by the center binding unit 304. In the case in which the center-fold biding is performed as illustrated in FIGS. 28A and 28B, the sheet of paper that is present on the outermost side is referred to as outermost paper $P_{out}$, and the sheet of paper that is present on the innermost side is referred to as innermost paper $P_{in}$. The outermost paper $P_{out}$ is also referred to as a cover. Plural sheets of paper other than the outermost paper $P_{out}$ and the innermost paper $P_{in}$, that is, the sheets of paper interposed between the outermost paper $P_{out}$ and the innermost paper $P_{in}$ are referred to as middle paper $P_m$.

Here, as illustrated in FIG. 28B, in the outermost paper $P_{out}$, the mountain portion $P_a$ of the crease is exposed and in the innermost paper $P_{in}$, the valley portion $P_b$ of the crease is exposed. Therefore, when an image is peeled off from the outermost paper $P_{out}$ or the innermost paper $P_{in}$, image peeling is visually recognized by eyes. However, the mountain portion $P_a$ and the valley portion $P_b$ of the crease in the middle paper $P_m$ are not exposed. Accordingly, even through the image peeling occurs in the middle paper $P_m$, image peeling is not visually recognized by eyes. Therefore, even when the image peeling occurs in the mountain portion $P_a$ or the valley portion $P_b$ of the crease in the middle paper $P_m$, it is not recognized. For such a reason, the crease forming device 200 does not form the crease in the middle paper $P_m$. Further, for the middle paper $P_m$, the generating unit 104 generates the crease information representing that the crease is not to be formed in the paper (the information "no crease forming"). However, for the outermost paper $P_{out}$ and the innermost paper $P_{in}$, the generating unit 104 generates the crease information representing that the crease is to be formed in the paper (the information "crease forming").

That is, the predetermined paper (the paper in which the crease is not to be formed) includes "(1) the paper on which a single color image is to be formed", "(2) the paper having the stretch property", "(3) the paper that comes to have the open angle θ greater than the threshold $\theta_{th}$ when sheets of paper are folded in a superimposing manner", "(3) the paper included in the number of sheets of paper, which is greater than the threshold, to be folded in a superimposing manner", "(4) the paper used for forming book-like image", and "(5) the middle paper when center-fold binding is performed".

The predetermined paper is not limited to the paper described in (1) to (5). That is, the crease forming device of the present embodiment does not perform the crease forming process on any type of paper if the paper has a property of causing nearly no image peeling thereon or being able to render the image peeling nearly recognizable. Further, the crease forming device 200 of the present embodiment does not perform the crease forming process on the paper that is scheduled not to undergo the folding process by the folding device 300.

Further, as the crease information, two or more from (1) to (5) described above may be combined.

Figure 29:
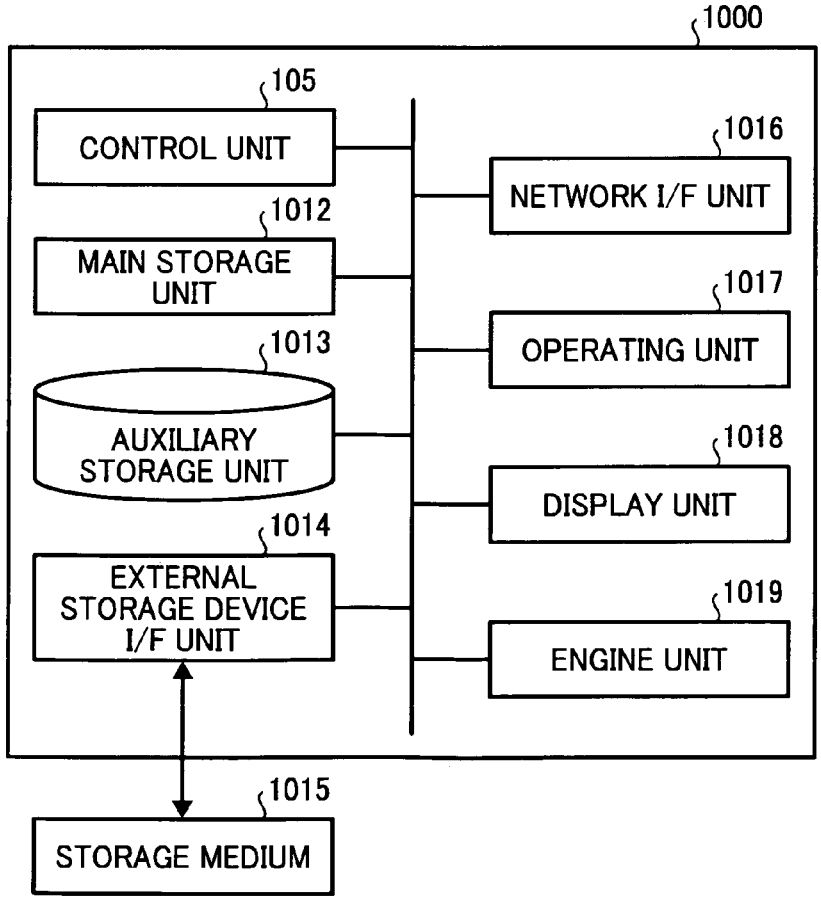
FIG. 29 is a block diagram illustrating an exemplary functional structure of the entire image forming apparatus according to the present embodiment, which is illustrated from a different point of view from FIG. 20.

FIG. 29 is a block diagram illustrating an exemplary functional structure of the entire image forming apparatus 1000 according to the present embodiment, which is illustrated from a different point of view from FIG. 20. As illustrated in FIG. 29, the image forming apparatus 1000 includes the control unit 105, a main storage unit 1012, an auxiliary storage unit 1013, an external storage device I/F unit 1014, a network I/F unit 1016, an operating unit 1017, a display unit 1018, and an engine unit 1019.

The control unit 105 is a central processing unit (CPU) that controls each device, unit, and section and computes and processes data in a computer. The control unit 105 also is a computing device that executes a program stored in the main storage unit 1012. The control unit 105 receives data from an input device or a storage device, computes and processes the data, and outputs the result to an output device or a storage device.

The main storage unit 1012 includes a read only memory (ROM) or a random access memory (RAM) and is a storage device that keeps or temporarily stores data or programs such as an operation system (OS) that is basic software or application software that are executed by the control unit 105.

The auxiliary storage unit 1013 is a storage device, which stores data related to application software, such as a hard disk drive (HDD). The external storage device I/F unit 1014 is an interface between a storage medium 1015 (for example, a flash memory) and the image forming apparatus which are connected via a data transmission path such as a universal serial bus (USB).

Further, a predetermined program is stored in the storage medium 1015, the program stored in the storage medium 1015 is installed in the image forming apparatus through the external storage device I/F unit 1014, and the installed predetermined program is executed by the image forming apparatus.

The network I/F unit 1016 is an interface between a peripheral device with a communication function and the image forming apparatus which are connected via a local area network (LAN) or a wide area network (WAN) constituted by a data transmission path such as a wired and/or wireless line.

Each of the operating unit 101 and the display unit 1018 includes a key switch (a hard key) and a liquid crystal display (LCD) with a touch panel function (including a software key of a graphical user interface (GUI)), and corresponds to a display and/or input device serving as a user interface (UI) when using functions of the image forming apparatus.

The engine unit 1019 is a machinery unit such as a plotter, a scanner, or the like that performs processing actually related to the image formation.

An image forming program of the present embodiment is an image forming program that forms an image using an endless belt. The image forming program is configured to cause a computer to execute an adding process of adding a pattern on the endless belt, a multiple-pattern detecting process of detecting the pattern, a computing process of computing an amount of inclination of the endless belt in the movement direction of the endless belt based on the detecting result of the pattern detecting process, and a correcting process of correcting the inclination of the endless belt in the movement direction based on the amount of inclination.

As described above, the crease forming device 200 of the present embodiment does not perform the crease forming process on all of the recording media but performs the crease forming process on the recording media other than the predetermined recording media. Therefore, the crease forming process may be performed in a reduced number of times. As a result, it is possible to improve productivity of the crease forming process, reduce the crease blade replacement cost, and reduce downtime even when the crease forming device is broken.

According to the crease forming device and the image forming apparatus of the invention, it is possible to improve productivity of the crease forming process, reduce the replacement cost of the crease blade, and reduce downtime even when the crease forming device is broken.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

an image forming unit that forms an image on a recording medium;

a conveying unit that conveys the recording medium on which the image is formed;

a crease forming unit, located upstream of a folding unit, that performs a crease forming process on the conveyed recording medium;

a determining unit that determines whether or not the recording medium is a predetermined recording medium; and a control unit that prohibits the crease forming process from being performed by the crease forming unit when the determining unit determines that the recording medium is the predetermined recording medium, wherein the crease forming unit includes a convex blade and a concave blade and performs the crease forming process on the recording medium conveyed to a position between the convex blade and the concave blade by nipping the recording medium by the convex blade and the concave blade, and the predetermined recording medium is a recording medium on which a single color image is formed by the image forming unit.

2. The image forming apparatus according to claim 1, wherein the folding unit folds a recording medium in a superimposing manner, and the predetermined recording medium is a recording medium that comes to have an open angle greater than a predetermined threshold when the recording medium is folded in a superimposing manner by the folding unit.

3. The image forming apparatus according to claim 1, wherein the folding unit folds a recording medium in a superimposing manner, wherein the predetermined recording medium is a recording medium included in the number of recording media, which is greater than a threshold value, to be folded in a superimposing manner by the folding unit.

4. The image forming apparatus according to claim 1, further comprising a center-fold binding unit that performs center-fold binding on the recording medium, wherein the predetermined recording medium is a recording medium other than an outermost recording medium and an innermost recording medium when the center-fold binding unit performs the center-fold binding.

5. The image forming apparatus according to claim 1, wherein the determining unit determines whether the recording medium is a predetermined recording medium based on at least one of a physical property of the recording medium and a fold instruction to the recording medium.

6. An image forming apparatus, comprising:

an image forming unit that forms an image on a recording medium;

a conveying unit that conveys the recording medium on which the image is formed;

a crease forming unit, located upstream of a folding unit, that performs a crease forming process on the conveyed recording medium;

a determining unit that determines whether or not the recording medium is a predetermined recording medium; and a control unit that prohibits the crease forming process from being performed by the crease forming unit when the determining unit determines that the recording medium is the predetermined recording medium, wherein the crease forming unit includes a convex blade and a concave blade and performs the crease forming process on the recording medium conveyed to a position between the convex blade and the concave blade by nipping the recording medium by the convex blade and the concave blade, and the predetermined recording medium is a recording medium having a stretch property.

7. An image forming apparatus, comprising:

an image forming unit that forms an image on a recording medium;

a conveying unit that conveys the recording medium on which the image is formed;

a crease forming unit, located upstream of a folding unit, that performs a crease forming process on the conveyed recording medium;

a determining unit that determines whether or not the recording medium is a predetermined recording medium; and a control unit that prohibits the crease forming process from being performed by the crease forming unit when the determining unit determines that the recording medium is the predetermined recording medium, wherein the crease forming unit includes a convex blade and a concave blade and performs the crease forming process on the recording medium conveyed to a position between the convex blade and the concave blade by nipping the recording medium by the convex blade and the concave blade, and the predetermined recording medium is a recording medium used for forming book image by the image forming unit in a manner such that images are arranged in an order of enabling a book to be made.

* * * * *